United States Patent [19]

Annergren et al.

[11] 4,451,332

[45] May 29, 1984

[54] METHOD FOR DELIGNIFICATION OF LIGNO-CELLULOSE CONTAINING FIBER MATERIAL WITH AN ALKALI-OXYGEN EXTRACTION STAGE

[75] Inventors: Göran E. Annergren, Sundsvall; Tjell-Åke Hägglund, Sörberge; Per-Olov Lindblad, Sundsvall; Lars-Åke T. Lindström; Lars E. Näsman, both of Alnö, all of Sweden

[73] Assignee: SCA Development Aktiebolag, Sweden

[21] Appl. No.: 403,070

[22] Filed: Jul. 29, 1982

Related U.S. Application Data

[63] Continuation of Ser. No. 140,499, Apr. 15, 1980, abandoned.

[30] Foreign Application Priority Data

May 11, 1979 [SE] Sweden ..... 7904148

[51] Int. Cl.[3] ..... D21C 9/12; D21C 9/14; D21C 11/04

[52] U.S. Cl. ..... 162/30.1; 162/40; 162/57; 162/65; 162/89

[58] Field of Search ..... 162/65, 90, 30.1, 30.11, 162/40, 19, 88, 89, 57

[56] References Cited

U.S. PATENT DOCUMENTS

| | | | |
|---|---|---|---|
| 3,759,783 | 9/1973 | Samuelson et al. | 162/65 |
| 3,830,688 | 8/1974 | Mannbro | 162/65 |
| 3,832,276 | 8/1974 | Roymoulik et al. | 162/65 |
| 3,963,561 | 6/1976 | Richter | 162/65 |
| 4,053,352 | 10/1977 | Hultman | 162/65 |
| 4,104,114 | 8/1978 | Rowlandson et al. | 162/30 K |
| 4,198,266 | 4/1980 | Kirk et al. | 162/65 |

FOREIGN PATENT DOCUMENTS

| | | | |
|---|---|---|---|
| 2460144 | 7/1975 | Fed. Rep. of Germany | 162/65 |

OTHER PUBLICATIONS

"First Oxygen Pulping/Bleaching Seminar Draws High Attendance, Good Papers", Paper Trade Journal, Feb. 28, 1979, pp. 20–24.

"Atmospheric–Pressure Oxygen Bleaching", Eachus; *TAPPI;* vol. 58, No. 9, pp. 151–154.

*Primary Examiner*—Steve Alvo

*Attorney, Agent, or Firm*—Lerner, David, Littenberg, Krumholz & Mentlik

[57] ABSTRACT

A method is disclosed for delignification of ligno-cellulose containing fiber material comprising mixing an oxygen-containing gas with the cellulose fiber material so as to atomize the gas and form a foam of the gas and the cellulose fiber material, and without an intervening oxidation step, subjecting the foam to upwardly flowing, substantially non-pressurized, alkali extraction. The alkali extraction step is conducted at a temperature of from about 40° to about 80° C. and at a pH, ligno cellulose containing fiber concentration and oxygen containing gas concentration sufficient to provide a bleached, delignified cellulose fiber without bleaching the lignin substance extracted from the material and to suppress lignin condensation reaction during the extraction.

11 Claims, No Drawings

METHOD FOR DELIGNIFICATION OF LIGNO-CELLULOSE CONTAINING FIBER MATERIAL WITH AN ALKALI-OXYGEN EXTRACTION STAGE

This is a continuation of application Ser. No. 140,499, filed Apr. 15, 1980, now abandoned.

FIELD OF THE INVENTION

The present invention relates to a method for delignification of ligno-cellulose containing fiber material during alkali extraction. More particularly, the present invention relates to a method for delignification of ligno-cellulose containing fiber material employing oxygen-containing gas as an oxidant in an alkali extraction step.

BACKGROUND OF THE INVENTION

The primary purpose of alkali extraction is to complete oxidation or bleaching of ligno-cellulose containing material while at the same time solvating the lignin from the material. Moreover, generally the first alkali extraction in a multi-step bleaching sequence is the most important one, because the first extraction is normally driven so that the strongest solvating of lignin is obtained. Such an alkali extraction is, however, considered to be the main cause of pulp discoloration. This and other negative effects are obtained due to some kind of lignin condensation during the alkali extraction owing to the aromatic-kinoidic structure of the lignin.

Various methods have been used previously to counteract the above-mentioned negative effects. In one method, a high temperature and/or an addition of oxidant, for example, peroxide and hypochlorite, have been employed. Such a method has its own disadvantages, however, e.g., the disproportionate expense of the heating variant. For example, when a high temperature is involved, the reaction mixture usually must be heated with steam, i.e., at a temperature above 60° to 70° C. Moreover, the oxidants proposed are generally either too expensive or not suitable in view of environmental requirements.

It has also been proposed to use oxygen as an oxidant an alkali extraction, and in fact oxygen has been employed on a factory scale. Such a technique, however, employs oxygen generally under the same conditions as in a so-called oxygen bleaching step immediately before the bleaching plant, i.e., treatment at high pressure and high temperature (about or above 100° C.) in a relatively complicated apparatus, which apparatus is different from the equipment normally used in bleaching plants. Thus, a more general utilization of such a technique is restricted for economic reasons, due to the high temperature and equipment required. Accordingly, such an oxygen step, on the whole, can only be motivated economically when, at the same time, the bleaching plant is operated in very short sequences, normally comprising three steps.

In addition, the last mentioned process employing oxygen within a bleaching sequence should be performed at a high pulp concentration (generally above 20%) due to the relatively high temperature. This effect has been described by Croon in Tappi Seminar Notes, Oxygen, Ozone and Peroxide Pulping and Bleaching Seminar, Nov. 9, 1978, New Orleans, La. Croon discloses that a lower pulp concentration was tried, but that it was found impossible to apply the above technique in an economic manner using the lower pulp concentration.

During recent years, oxygen bleaching of entirely unbleached pulp at lower pulp concentrations (preferably, about 10% by weight) has been subject to development work in several places. The aims of such development work have been to simplify the apparatus equipment and to obtain a higher selectivity. This oxygen bleaching technique is based on a mixing apparatus which fluidizes the pulp suspension by very strong shear fields and simultaneously disintegrates or atomizes the oxygen into very fine bubbles. The bubbles of oxygen are distributed as uniformly as possible in the fluidized pulp suspension forming a foam. The resulting foam is dissolved as the oxygen is consumed in the bleaching reaction. In such a reaction, it is desirable to stabilize the foam so as to prevent the gas bubbles in the foam from uniting, as this uniting would substantially reduce the interface between the gas and the liquid/fibers. One counter-measure used to stabilize the foam is to limit the extent of the shear field so that the fluidization rapidly is abolished and the foam structure is locked by the fiber network. Another such counteracting measure is to mix in with the material a foam-forming waste liquor substance such as black liquor dry substance or bleaching plant waste liquor dry substance. The proposed uses of such a technique have aimed at completion of the bleaching reaction in a high pressure vessel of similar design to that used for normal oxygen bleaching at high pump concentration.

SUMMARY OF THE INVENTION

It has now been found that delignification of ligno-cellulose containing fiber material can be economically accomplished by a process comprising mixing an oxygen-containing gas with the ligno-cellulose containing fiber material so as to atomize the gas and form a foam of the gas and the material. Without an intervening step, such as another separate oxidtion of bleaching step, the foam is subjected to an upward flowing, substantially non-pressurized, alkali extraction. This extraction step is conducted at a temperature of from about 40° C. to about 80° C. and at a pH, ligno-cellulose containing fiber concentration and oxygen-containing gas concentration sufficient to provide a bleached, delignified cellulose fiber without bleaching the lignin substance extracted from the material and to suppress lignin condensation reaction during the extraction.

The method of the present invention has a number of advantages. First, it can be used directly in a conventional bleaching plant having a tower with upward flow, which is quite normal. Also, the investment required normally is only in a mixer with its associated auxiliary apparatus. Moreover, no special heating for the oxidative treatment is required and the characteristics of the product obtained by the process are fully of the same quality as those obtained with previously proposed oxygen bleaching methods, such as those described above. It should be noted, however, that the present invention should not be regarded as a pure oxygen bleaching step, but rather as an intensified alkali extraction step in which the negative side reactions are suppressed by maintaining certain conditions in the extraction step.

DETAILED DESCRIPTION OF INVENTION

The present invention is preferably employed with pulp which has been bleached in a conventional manner prior to mixing with the oxygen-containing gas. Such bleaching is, normally performed using chlorine, chlorine dioxide or mixtures of these two. Also, a conventional oxygen bleaching prior to such a chlorine and/or chlorine dioxide treatment can also be employed.

The present invention employs an upward-flow, substantially non-pressurized alkali extraction. This step in the process of the present invention can thus be performed by conventional upward flow alkali extraction towers well known in the art.

Preferably, the oxygen containing gas and the ligno-cellulose containing fiber material are mixed by a mixer installed in the pulp conduit immediately before the upward-flow alkali extraction tower. The mixer admixes the oxygen-containing gas as fine gas bubbles with the ligno-cellulose containing fiber material so as to form a foam of the gas and the material. Conventional mixers known in the art can be used for this purpose. After mixing, the foam is stabilized due to the fact that the shear forces cease. As another method for stabilizing the foam, a certain part of the waste liquor from the alkali extraction step can also be recovered, recirculated and mixed with the material and oxygen-containing gas in forming the foam.

In a preferred embodiment of the invention, the concentration of the ligno-cellulose containing fiber is in the range of from about 6 to about 18% by weight of the material to be mixed. More preferably, the concentration of the ligno-cellulose containing fiber is in the range of from about 10 to about 15% by weight, and most preferably, from about 10 to about 12% by weight of the material to be mixed.

The oxygen-containing gas is preferably mixed with the ligno-cellulose containing fiber material in an amount corresponding to from about 5 to about 150% by weight of oxygen calculated based on the lignin content of the ligno-cellulose containing fiber material to be mixed, i.e., the material entering from a preceding bleaching step. More preferably, the oxygen-containing gas is mixed with the ligno-cellulose containing material in an amount corresponding to from about 5 to about 50% by weight of oxygen calculated on the same basis.

One of the advantages of the process of the invention is that the temperature in the extraction step can be maintained at a low level. Suitable temperatures for the extraction step of the present invention can range from about 40° to about 80° C., preferably from about 50° to about 70° C. A particularly suitable temperature is one of about 65° C.

The pH of the alkali charge to the extraction step of the process of the present invention is normally adjusted so that the final pH is maintained at the normal pH for alkali extraction processes. Preferably, the pH is adjusted so that the final pH in the extraction step is greater than 9. Thus, the alkali charge normal for alkali extraction may be increased by less than 10 kilograms per ton of ligno-cellulose containing fiber material, and more preferably, increased by 4 to 8 kilograms per ton of such material.

The amount of oxygen added during the mixing step of the present invention is limited so as to neutralize or suppress the undesired reactions of the alkali extraction step and so as not to substantially bleach the lignin substance extracted during the extraction step. Thus, the method of the present invention differs in this respect from other methods using hydrogen peroxide or hypochloride in an alkali extraction step for which other methods a substantial bleaching of the waste liquor of the extraction step is reported. Thus, in a preferred embodiment of the present invention, oxygen is added in less than 10 kilograms per ton of pump (i.e., ligno-cellulose containing fiber), and more preferably 4 to 8 kilograms per ton of pulp and so as to provide a COD reaction in the waste liquor of about 10%. The reason for limiting the oxygen addition is that the reaction in its entirety should be carried out at a low temperature (preferably 50° to 70° C.) and at relatively short reaction times (preferably 90 minutes or less). Moreover, it is also preferable to limit the amount of gas so that the stability of the pulp flow through the bleaching tower is not jeopardized.

Due to the temperature, pressure and oxygen-containing gas concentration limitations placed on the process of the present invention, one skilled in the art could have expected a considerable reduction in the delignification effect using the present invention relative to previously described oxygen steps at higher pressure and higher temperature. The present applicants have found this not to be the case. Rather, we have found that the delignification effect using the process of the present invention is on the same level as that of the oxygen steps at higher pressure and temperature previously described. Although we do not wish to be limited by any theory of the invention, it is believed that this effect is due to the fact that the alkali extraction step of the present invention potentially has an effect higher than expected, i.e., the undesired condensation reactions of lignin are of greater importance than expected and that these undesired effects are neutralized efficiently using the very intensive, but limited oxidation, of the present invention, which preferably takes place at a stage as early as in the mixer. The present invention demonstrates that oxygen is very reactive with pulp when mixed in accordance with the present invention immediately prior to an alkali extraction step so long as the material transfer problem between the gas and liquid/fiber surfaces can be eliminated as is done in the present invention by use of a mixer to form a foam of the gas and the liquid/fiber material.

The process of the present invention can employ various pretreatments, i.e., bleaching steps, well known in the art, e.g., by chlorine/chlorine dioxide. Preferably, the ingoing pulp has been bleached previously in several steps. It has been shown in accordance with the present invention, however, that it is especially favorable to limit the chemical addition during such pretreatment to a low level, e.g., a level from about 10 to about 30% below that used in processing employing a normal alkali extraction step, because the remainder of such chemicals when carried over into the alkali extraction appear to have an effect similar to oxygen oxidation in the alkali extraction in accordance with the present invention. Thus, the ingoing pulp is preferably pretreated with a chemical addition which is lower than normal in the step preceding the process of the invention. This is of special interest when for environmental reasons the pre-bleaching is carried out with only chlorine dioxide rather than the chlorine. Since chlorine dioxide is relatively expensive and an energy requiring chemical, there is thus motivation to minimize its use, although in other respects it is an excellent chemical.

In another embodiment of the invention, the pulp is finally bleached in one or more several steps. In addition, in still another embodiment waste liquor from the alkali extraction step of the process of the invention is returned entirely or partially to a recovery system in the pulp mill and the organic substances of the waste liquor are destroyed by combustion.

The following examples are intended to exemplify, but not limit the process of the present invention.

EXAMPLE 1

A process in accordance with the present invention was performed on coniferous sulfate pulp. This pulp was treated with a bleaching sequence employing conventional bleaching techniques along with the process steps of the present invention. The pulp was first treated by normal oxygen bleaching (O), then by chlorine/-chlorine dioxide bleaching (C/D), then by an oxygen-intensified alkali extraction step in accordance with the present invention where the oxygen-containing gas was mixed with the pulp material to form a foam immediately prior to an upward-flowing, substantially non-pressurized, extraction step (EO), then by chloride dioxide bleaching (D), then by normal caustic extraction (E), and finally by chlorine dioxide bleaching (D). The oxygen-intensified alkali extraction step (EO) of the present invention was performed at 65° C. and the oxygen pre-step (O) employed a pulp concentration of 10–15% by weight or 25–30% by weight. The Kappa numbers of the unbleached pulp and the pre-bleached pulp, the final brightness and the viscosity of the pulp were determined. In addition, the chemical consumption of sodium hydroxide and oxygen during the oxygen-intensified alkali extraction step of the present invention were determined along with the total amount of active chlorine, sodium hydroxide and oxygen consumed during the process. These results are tabulated in Table 1 below.

TABLE 1

| | |
|---|---|
| Bleaching sequence | O-C/D-EO-D-E-D |
| Kappa number of unbleached pulp/ Kappa number of oxygen pre-bleached pulp: | 35/20 |
| Final brightness | 89.5% ISO |
| Viscosity | 915 $dm^3/kg$ |
| Chemical Consumption during EO step | |
| NaOH | 25 kg per ton of pulp (ptp) |
| $O_2$ | 5 kg ptp |
| Chemical Consumption during total process | |
| active chlorine | 40 kg ptp |
| NaOH | 45–50 kg ptp |
| $O_2$ | 23 kg ptp |

EXAMPLE 2

The procedure of Example 1 was repeated, except that a bleaching sequence of O-D-EO-D-E-D was employed. The same properties for such a process as described in Example 1 were determined and are tabulated in Table 2 below.

TABLE 2

| | |
|---|---|
| Bleaching Sequence | O-D-EO-D-E-D |
| Kappa number of unbleached pulp/ Kappa number of oxygen pre-bleached pulp: | 35/20 |
| Final brightness | 89.5% ISO |
| Viscosity | 945 $dm^3/kg$ |
| Chemical Consumption during EO step | |
| NaOH | 23 kg ptp |
| $O_2$ | 5 kg ptp |
| Chemical Consumption during total process | |

TABLE 2-continued

| | |
|---|---|
| active chlorine | 37 kg ptp |
| NaOH | 47 kg ptp |
| $O_2$ | 23 kg ptp |

EXAMPLE 3

The procedure of Example 1 was again repeated, except that the bleaching sequence used was O-D-EO-D. Again, the same characteristics of the process were determined and are tabulated in Table 3 below.

TABLE 3

| | |
|---|---|
| Bleaching Sequence | O-D-EO-D |
| Kappa number of unbleached pulp/ Kappa number of oxygen pre-bleached pulp: | 35/20 |
| Final brightness | 89.5% ISO |
| Viscosity | 900 $dm^3/kg$ |
| Chemical Consumption during EO step | |
| NaOH | 25 kg ptp |
| $O_2$ | 5 kg ptp |
| Chemical Consumption during total process | |
| active chlorine | 50 kg ptp |
| NaOH | 43 kg ptp |
| $O_2$ | 23 kg ptp |

EXAMPLE 4

The procedure of Example 1 was again repeated, except that the bleaching sequence used was O-C/D-EO-D. Again, the same characteristics of the process were determined and are tabulated in Table 4 below.

TABLE 4

| | |
|---|---|
| Bleaching sequence | O-C/D-EO-D |
| Kappa number of unbleached pulp/ Kappa number of oxygen pre-bleached pulp: | 35/20 |
| Final brightness | 89.5% ISO |
| Viscosity | 915 $dm^3/kg$ |
| Chemical Consumption during EO step | |
| NaOH | 28 kg ptp |
| $O_2$ | 5 kg ptp |
| Chemical Consumption during total process | |
| active chlorine | 50 kg ptp |
| NaOH | 45 kg ptp |
| $O_2$ | 23 kg ptp |

EXAMPLE 5

The procedure of Example 1 was repeated, except that a bleaching sequence of D/C-EO-D was employed without an oxygen pre-step. The Kappa number of the unbleached pulp, the final brightness, and the viscosity of the material were determined along with the chemical consumption during the process of the active chlorine, sodium hydroxide and oxygen. These characteristics for the process of this example are listed below in Table 5.

TABLE 5

| | |
|---|---|
| Bleaching sequence | D/C-EO-D |
| Kappa number of unbleached pulp | 32 |
| Final brightness | 89.5% ISO |
| Viscosity | 940 $dm^3/kg$ |
| Chemical Consumption during total process | |
| active chlorine | 75 kg ptp |
| NaOH | 35 kg ptp |

TABLE 5-continued

| | |
|---|---|
| $O_2$ | 5 kg ptp |

EXAMPLE 6

The procedure of Example 1 was again repeated, except that the bleaching sequence used of D-EO-D. The Kappa number for the unbleached pulp, the final brightness and viscosity of the material were determind along with the chemical consumption during the process of the active chlorine, sodium hydroxide and oxygen. These characteristics of this process are listed below in Table 6.

TABLE 6

| | |
|---|---|
| Bleaching sequence | D-EO-D |
| Kappa number of unbleached pulp | 32 |
| Final brightness | 89.5% ISO |
| Viscosity | 920 $dm^3/kg$ |
| Chemical Consumption during total process | |
| active chlorine | 80 kg ptp |
| NaOH | 30 kg ptp |
| $O_2$ | 5 kg ptp |

EXAMPLE 7

For purposes of comparison, three experiments (7A, 7B and 7C) using various conventional bleaching processes of coniferous sulfate pulp were performed. The bleaching sequence for each of these processes is indicated at the top of the column for each of these Examples 7A, 7B and 7C. The characteristics of the product of these processes and the chemical consumption during each of these processes are indicated below in Table 7.

TABLE 7

| | Example 7A | Example 7B | Example 7C |
|---|---|---|---|
| Bleaching sequence | D/C-E-D-E-D | O-C/D-E-D-E-D[1] | O-D-E-D-E-D |
| Kappa number of unbleached pulp | 32 | 35 | 35 |
| Kappa number of unbleached pulp/ Kappa number of oxygen pre-bleached pulp | not applicable | 35/18 | 35/18 |
| Final brightness | 89.5% ISO | 89.5% ISO | 89.5% ISO |
| Viscosity | 970 $dm^3/kg$ | 915 $dm^3/kg$ | 945 $dm^3/kg$ |
| Chemical Consumption: | | | |
| active chlorine | 90 kg ptp | 54 kg ptp | 50 kg ptp |
| NaOH | 39 kg ptp | 44 kg ptp | 42 kg ptp |
| $O_2$ | not applicable | 18 kg ptp | 18 kg ptp |

[1]10–15% by weight pulp concentration or 25–30% by weight pulp concentration was employed in the oxygen pre-step.

It will be understood that the embodiments described herein are merely exemplary and that a person skilld in the art may make many variations and modifications without departing from the spirit and scope of the invention. All such modifications and variations are intended to be included within the scope of the invention as defined in the appended claims.

What is claimed is:

1. A process for treating ligno-cellulose containing fiber material comprising the steps of bleaching a ligno-cellulose containing fiber material bleached with chlorine, chlorine dioxide or mixtures thereof; mixing said bleached ligno-cellulose containing fiber material at a pulp consistency of greater than 10% up to 18% with an oxygen-containing gas in a mixer arranged immediately before a substantially non-pressurized upward flowing extraction tower to provide a foam of the pulp suspension having said gas dispersed therein in an amount of from about 4 to about 8 kilograms of oxygen per ton of pulp; passing said foam suspension from the mixer to the upward flowing extraction tower; and extracting the pulp suspension in the upward flowing extraction tower for a reaction time of less than about 90 minutes, at a temperature of from about 50° to about 70° C., and at an addition of alkali such that the final pH measured in the pulp suspension is greater than 9.

2. A method according to claim 1, wherein the consistency of the ligno-cellulose containing fiber is in the range of from about 10 to about 12% by weight of said suspension.

3. A method according to claim 1, wherein said oxygen-containing gas is mixed with said material in an amount corresponding to from about 5 to about 150% by weight of oxygen calculated based on the lignin content of said ligno-cellulose containing fiber material to be mixed.

4. A method according to claim 1, wherein said oxygen-containing gas is mixed with said material in an amount corresponding to from about 5 to about 50% by weight of oxygen calculated based on the lignin content of said ligno-cellulose containing fiber material to be mixed.

5. A method according to claim 1, wherein from about 5 to about 100% by weight of the waste liquor from said extraction step is recirculated and mixed with said ligno-cellulose containing fiber material and said oxygen-containing gas.

6. A method according to claim 1, wherein said temperature is about 65° C.

7. A method according to claim 1, further comprising recovering waste liquor from the alkali extraction step and combusting the organic substances of said waste liquor.

8. A method according to claim 1, wherein, prior to said treatment with chlorine or chlorine dioxide or mixtures thereof, the cellulose-containing fiber material is subjected ot at least one additional separate bleaching step.

9. A method according to claim 8, wherein said at least one additional separate bleaching step is performed with a member selected from the group consisting of chlorine, chlorine dioxide, oxygen or mixtures thereof.

10. A method according to claim 9, wherein prior to said extraction said ligno-cellulose containing fiber material is oxygen bleached.

11. A process according to claim 1, wherein the foam suspension is passed from the mixer to the extraction tower without an intervening treatment step, said extracting of the pulp being performed under conditions such that lignin condensation during extraction and bleaching of lignin substance extracted from the material is suppressed.

* * * * *

UNITED STATES PATENT AND TRADEMARK OFFICE

CERTIFICATE OF CORRECTION

PATENT NO. : 4,451,332

DATED : May 29, 1984

INVENTOR(S) : Annergren et al.

It is certified that error appears in the above-identified patent and that said Letters Patent are hereby corrected as shown below:

Column 2, line 39, "oxidtion" should read --oxidation--.
Column 4, line 3, "pump" should read --pulp--.
Column 4, line 60, "the" should read --with--.
Column 7, Table 7, under column entitled Example 7C, "O-D-E-D-E-D" should read --O-D-E-D-E-$D^1$--.
Column 7, line 52, "skilld" should read --skilled--.
Column 8, line 7, after "9" insert --, said extracting of the pulp being performed under conditions such that lignin condensation during extraction and bleaching of lignin substance extracted from the material is suppressed--.
Column 8, line 53, "ot" should read --to--.
Column 8, lines 64-58, delete ", said extracting of the pulp being performed under conditions such that lignin condensation during extraction and bleaching of lignin substance extracted from the material is suppressed--.

Signed and Sealed this

Twenty-third Day of October 1984

[SEAL]

Attest:

GERALD J. MOSSINGHOFF

Attesting Officer

Commissioner of Patents and Trademarks